US006972104B2

(12) United States Patent
Haynes et al.

(10) Patent No.: US 6,972,104 B2
(45) Date of Patent: Dec. 6, 2005

(54) MELTBLOWN DIE HAVING A REDUCED SIZE

(75) Inventors: Bryan David Haynes, Advance, NC (US); Michael Charles Cook, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/745,207

(22) Filed: Dec. 23, 2003

(65) Prior Publication Data

US 2005/0133971 A1 Jun. 23, 2005

(51) Int. Cl.[7] ..... D01D 5/08

(52) U.S. Cl. ..... 264/211.14; 425/66; 425/382.2; 425/DIG. 17

(58) Field of Search ..... 425/66, 72.2, 7, 425/382.2, 464, DIG. 17, DIG. 217; 156/62.4, 156/167, 244.11; 264/172.17, 211.14

(56) References Cited

U.S. PATENT DOCUMENTS

| | | | | |
|---|---|---|---|---|
| 3,016,599 | A | | 1/1962 | Perry, Jr. |
| 3,704,198 | A | | 11/1972 | Prentice |
| 3,755,527 | A | | 8/1973 | Keller et al. |
| 3,825,379 | A | | 7/1974 | Lohkamp et al. |
| 3,825,380 | A | | 7/1974 | Harding et al. |
| 3,849,241 | A | | 11/1974 | Butin et al. |
| 3,865,535 | A | | 2/1975 | Langdon et al. |
| 3,936,262 | A | | 2/1976 | Hehl |
| 3,978,185 | A | | 8/1976 | Butin et al. |
| 4,100,324 | A | | 7/1978 | Anderson et al. |
| 4,118,531 | A | | 10/1978 | Hauser |
| 4,380,570 | A | | 4/1983 | Schwarz |
| 4,486,161 | A | | 12/1984 | Middleton |
| 4,663,220 | A | | 5/1987 | Wisneski et al. |
| 4,720,252 | A | | 1/1988 | Appel et al. |
| 4,818,463 | A | * | 4/1989 | Buehning ..... 264/40.1 |
| 4,826,415 | A | | 5/1989 | Mende |
| 4,889,476 | A | | 12/1989 | Buehning |
| 4,986,743 | A | | 1/1991 | Buehning |
| 5,080,569 | A | | 1/1992 | Gubernick et al. |
| 5,087,186 | A | | 2/1992 | Buehning |
| 5,098,636 | A | | 3/1992 | Balk |
| 5,145,689 | A | | 9/1992 | Allen et al. |
| 5,236,641 | A | | 8/1993 | Allen et al. |
| 5,248,247 | A | | 9/1993 | Rubhausen et al. |
| 5,269,670 | A | | 12/1993 | Allen et al. |
| 5,344,297 | A | | 9/1994 | Hills |
| 5,421,921 | A | | 6/1995 | Gill et al. |
| 5,421,941 | A | | 6/1995 | Allen et al. |
| 5,423,935 | A | | 6/1995 | Benecke et al. |
| 5,445,509 | A | | 8/1995 | Allen et al. |
| 5,458,291 | A | | 10/1995 | Brusko et al. |

(Continued)

FOREIGN PATENT DOCUMENTS

| | | |
|---|---|---|
| EP | 0 474 421 A2 | 3/1992 |

(Continued)

*Primary Examiner*—Joseph S. Del Sole
(74) *Attorney, Agent, or Firm*—Ralph H. Dean, Jr.; Robert A. Ambrose

(57) ABSTRACT

The present invention provides a meltblown die which has a considerable smaller width in the machine direction of the meltblowing process compared to conventional and commercially used meltblown dies. The meltblown die of the present invention has a. a die body; b. a die tip mounted to the die body; c. a first air plate mounted to the die body; and d. a second air plate mounted to the die body. In addition, the small size of the meltblown die of the present invention provides advantages over conventional meltblown die, including improved air entrainment.

18 Claims, 8 Drawing Sheets

U.S. PATENT DOCUMENTS

| | | | |
|---|---|---|---|
| 5,476,616 | A | 12/1995 | Schwarz |
| 5,516,476 | A | 5/1996 | Haggard et al. |
| 5,580,581 | A | 12/1996 | Buehning |
| 5,595,699 | A | 1/1997 | Wright et al. |
| 5,605,706 | A | 2/1997 | Allen et al. |
| 5,605,720 | A | 2/1997 | Allen et al. |
| 5,607,701 | A | 3/1997 | Allen et al. |
| 5,618,566 | A | 4/1997 | Allen et al. |
| 5,632,938 | A | 5/1997 | Buehning |
| 5,679,042 | A | 10/1997 | Varona |
| 5,679,379 | A | 10/1997 | Fabbricante et al. |
| 5,725,812 | A | 3/1998 | Choi |
| 5,728,219 | A | 3/1998 | Allen et al. |
| 5,733,581 | A | 3/1998 | Barboza et al. |
| 5,851,562 | A | 12/1998 | Haggard et al. |
| 5,882,573 | A | 3/1999 | Kwok et al. |
| 5,891,482 | A | 4/1999 | Choi |
| 5,902,540 | A | 5/1999 | Kwok |
| 5,904,298 | A | 5/1999 | Kwok et al. |
| 5,976,427 | A | 11/1999 | Choi |
| 6,074,597 | A | 6/2000 | Kwok et al. |
| 6,182,732 | B1 | 2/2001 | Allen |
| 6,183,670 | B1 | 2/2001 | Torobin et al. |
| 6,210,141 | B1 | 4/2001 | Allen |
| 6,220,843 | B1 | 4/2001 | Allen |
| 6,241,503 | B1 | 6/2001 | Wright et al. |
| 6,296,463 | B1 | 10/2001 | Allen |
| 6,315,806 | B1 | 11/2001 | Torobin et al. |
| 6,364,647 | B1 | 4/2002 | Sanborn |
| 6,378,784 | B1 | 4/2002 | Allen et al. |
| 6,422,428 | B1 | 7/2002 | Allen et al. |
| 6,422,848 | B1 | 7/2002 | Allen et al. |
| 6,427,745 | B1 | 8/2002 | Allen |
| 6,491,507 | B1 | 12/2002 | Allen |
| 6,502,615 | B1 | 1/2003 | Allen |
| 6,540,831 | B1 | 4/2003 | Craine et al. |
| 6,565,344 | B2 | 5/2003 | Bentley et al. |
| 6,572,033 | B1 | 6/2003 | Pullagura et al. |
| 6,596,205 | B1 | 7/2003 | Choi |
| 2002/0053390 | A1 | 5/2002 | Allen |

FOREIGN PATENT DOCUMENTS

| | | |
|---|---|---|
| EP | 0 474 422 A2 | 3/1992 |
| EP | 0633339 | 1/1995 |
| EP | 0 701 010 A1 | 3/1996 |
| EP | 0 987 352 A2 | 3/2000 |
| EP | 0 866 152 B1 | 11/2002 |
| EP | 1 270 770 A2 | 1/2003 |
| EP | 0 822 053 B1 | 6/2003 |
| JP | 54103466 A | 8/1979 |
| WO | WO 00/79034 | 12/2000 |
| WO | WO 02/42043 | 5/2002 |

* cited by examiner

MELTBLOWN DIE HAVING A REDUCED SIZE

FIELD OF THE INVENTION

The present invention relates to a meltblown die assembly and the formation of fibers using the meltblown die assembly in a meltblowing process.

BACKGROUND OF THE INVENTION

The formation of fibers and nonwoven webs by meltblowing is well known in the art. See, by way of example, U.S. Pat. No. 3,016,599 to R. W. Perry, Jr.; U.S. Pat. No. 3,704,198 to J. S. Prentice; U.S. Pat. No. 3,755,527 to J. P. Keller et al.; U.S. Pat. No. 3,849,241 to R. R. Butin et al.; U.S. Pat. No. 3,978,185 to R. R. Butin et al.; U.S. Pat. No. 4,100,324 to R. A. Anderson et al.; U.S. Pat. No. 4,118,531 to E. R. Hauser; and U.S. Pat. No. 4,663,220 to T. J. Wisneski et al.

Briefly, meltblowing is a process developed for the formation of fibers and nonwoven webs; the fibers are formed by extruding a molten thermoplastic polymeric material, or polymer, through a plurality of small holes. The resulting molten threads or filaments pass into converging high velocity gas streams, which are often heated, that attenuate or draw the filaments of molten polymer to reduce their diameters. Thereafter, the meltblown fibers are carried by the high velocity gas stream and deposited on a collecting surface, or forming wire, to form a nonwoven web of randomly dispersed meltblown fibers.

Generally, meltblowing utilizes a specialized apparatus to form the meltblown webs from a polymer. Often, the polymer flows from a die through narrow cylindrical outlets and forms meltblown fibers. The narrow cylindrical outlets may be arrayed in a substantially straight line and lie in a plane which is the bisector of a V-shaped die tip. Typically the angle formed by the exterior walls or faces of the V-shaped die tip is 60 degrees and is positioned proximate to a pair of air plates, thereby forming two slotted channels along each face of the die tip. Thus, air may flow through these channels to impinge on the fibers exiting from the die tip, thereby attenuating the fibers. As a result of various fluid dynamic actions, the air flow is capable of attenuating the fibers to diameters of from about 0.1 to 10 micrometers; such fibers generally are referred to as "microfibers". Larger diameter fibers, of course, also are possible, with the diameters ranging from around 10 micrometers to about 100 micrometers. Generally, fibers having a fiber diameter greater than about 40 micrometers are referred to a "macrofibers".

The conventional meltblown die assembly has changed little since the 1960s. The most widely used configuration is the type design which is described in U.S. Pat. No. 3,825,380. A majority of the commercially available MB systems are comprised of a die body, die tip and air plates. Over the years, there have been improvements to the mechanical and air distribution systems of the meltblown dies, but little has been accomplished to change the physics of the standard meltblown dies.

One of the problems with the current meltblown dies is the large amount of space required per meltblown die. Current meltblown designs can require 1.0 to 1.5 meters (3 to 5 feet), often 1.25 to 1.5 meters (4 to 5 feet) of length in the machine direction per meltblown bank, including the air handling equipment. Since it is often advantageous to have more than one meltblown bank on a production line, a relatively large amount of floor space is needed to accommodate a production line having one or more meltblown die assemblies.

SUMMARY OF THE INVENTION

The present invention provides a meltblown die which has a considerably smaller width in the machine direction of the meltblowing process compared to conventional and commercially used meltblown dies. The meltblown die of the present invention has a. a die body;

b. a die tip mounted to the die body;

c. a first air plate mounted to the die body; and d. a second air plate mounted to the die body. The overall width of the meltblowing die in the machine direction is less than about 16 centimeters (6.25 inches). In the present invention, desirably the overall width in the machine direction of the meltblown die assembly is generally in the about 5 to 10 centimeters range (2 to 4 inches).

In another embodiment of the present invention, a meltblowing die is described having a. a die body;

b. a die tip having a top side, a bottom side, a first side and a second side, wherein the top side is mounted to the die body, the bottom side is opposite the topside, the first side and the second side each extend from the topside towards the bottom side, and the first side and the second side are opposite each other;

c. a first air plate, wherein a portion of the first air plate is in contact with the first side of the die tip and a series of channels are formed by the first side of the die tip and the first air plate; and d. a second air plate, wherein a portion of the second air plate is in contact with the second side of the die tip and series of channels are formed by the second side of the die tip and the second air plate. In this embodiment of the present invention the channels may be desirably formed on the first side and second sides of the tip such that each of the first and second sides of the die tip have a surface comprising a series of raised portions extending from the top side the die tip towards the bottom side of the die tip. These raised portion define a series of channels between the raised portions on each side of the die tip extending from the top side of the die tip towards the bottom side of the die tip. The first air plate contacts at least a portion of the raised portions of the first side of the die tip and the second air plate contacts with least a portion of the raised portions of the second side of the die tip. The channels on the sides of the die tip and the air plates provide passages which allow the attenuating fluid to pass form the die body to an outlet of the meltblowing die.

In another embodiment of the present invention, a meltblowing die is describe having a. a die body;

b. a die tip mounted to the die body;

c. a first air plate mounted to the die body;

d. a second air plate mounted to the die body; and e. a distribution chamber which provides a pathway for a material to be formed into a fiber from the die body to the die tip wherein the distribution chamber has a non-linear shape in the cross-machine direction. By having distribution chamber with a non-linear shape, the mounting means which mount the die tip to the die body set in a staggered fashion, typically from side to side in the die tip, while providing a sufficiently sturdy mechanism to hold the die tip in place during use.

In each of the embodiments of the present invention, the die body may further have a mounting plate mounted to the die body. If present, the air plates and die tip are mounted to the mounting plate.

DEFINITIONS

Figure 1:
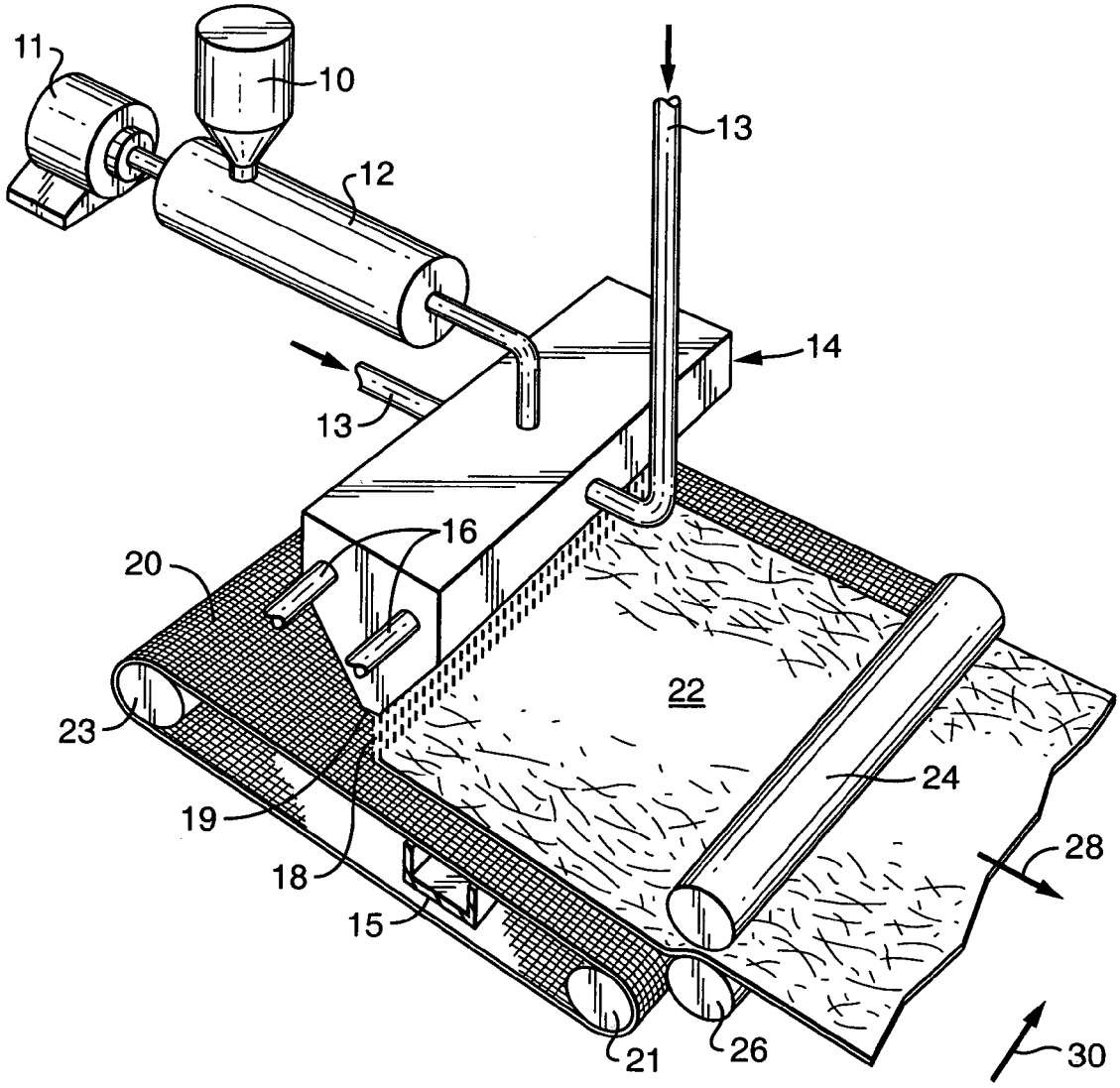
FIG. 1 Prior Art
FIG. 1 shows a schematic of a standard meltblowing process.

As used herein, the term "comprising" is inclusive or open-ended and does not exclude additional unrecited elements, compositional components, or method steps.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates and materials added to enhance processability of the composition.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein, the term "nonwoven web" means a web having a structure of individual fibers or threads which are interlaid, but not in an identifiable manner as in a knitted web. Nonwoven webs have been formed from many processes, such as, for example, meltblowing processes, spunbonding processes, air-laying processes, coforming processes and bonded carded web processes. The basis weight of nonwoven webs is usually expressed in ounces of material per square yard (osy) or grams per square meter (gsm) and the fiber diameters useful are usually expressed in microns, or in the case of staple fibers, denier. It is noted that to convert from osy to gsm, multiply osy by 33.91.

"Meltblown" refers to fibers formed by extruding a molten thermoplastic material through a plurality of fine, usually circular, die capillaries as molten threads or filaments into converging high velocity heated gas (e.g., air) streams which attenuate the filaments of molten thermoplastic material to reduce their diameters. Thereafter, the meltblown fibers are carried by the high velocity gas stream and are deposited on a collecting surface to form a web of randomly dispersed meltblown fibers. Meltblowing processes can be used to make fibers of various dimensions, including macrofibers (with average diameters from about 40 to about 100 microns), textile-type fibers (with average diameters between about 10 and about 40 microns), and microfibers (with average diameters less than about 10 microns). Meltblowing processes are particularly suited to making microfibers, including ultra-fine microfibers (with average diameters of about 3 microns or less). Meltblown fibers may be continuous or discontinuous, and are generally self bonding when deposited onto a collecting surface. The meltblown process is well-known and is described by various patents and publications described above.

The term "machine direction" as used herein refers to the direction of travel of the forming surface onto which fibers are deposited during formation of a material.

The term "cross machine direction" as used herein refers to the direction in the same plane of the web being formed which is perpendicular to machine direction.

DETAILED DESCRIPTION OF THE INVENTION

To obtain a better understanding of the present invention, attention is directed to FIG. 1, which generally shows a conventional meltblowing process of the prior art. Generally described, in a meltblowing process, a hopper 10 provides polymer to extruder 12 which is driven by motor 11 and heated to bring the polymer to the desired temperature and viscosity. The molten polymer is provided to die 14 which may also be heated by means of heater 16. The die is connected by conduits 13 to a source of attenuating fluid. At the exit 19 of die 14, fibers 18 are formed and collected on a forming belt 20 with the aid of an optional suction box 15 formed a web 22 which may be compacted or otherwise bonded by rolls 24 and 26. Belt 20 may be rotated by means of a driven roll which may be either 21 or 23, for example. In FIG. 1, the direction and arrow 30 show a direction perpendicular to the machine direction, which is referred to as the cross-machine direction.

Figure 2:
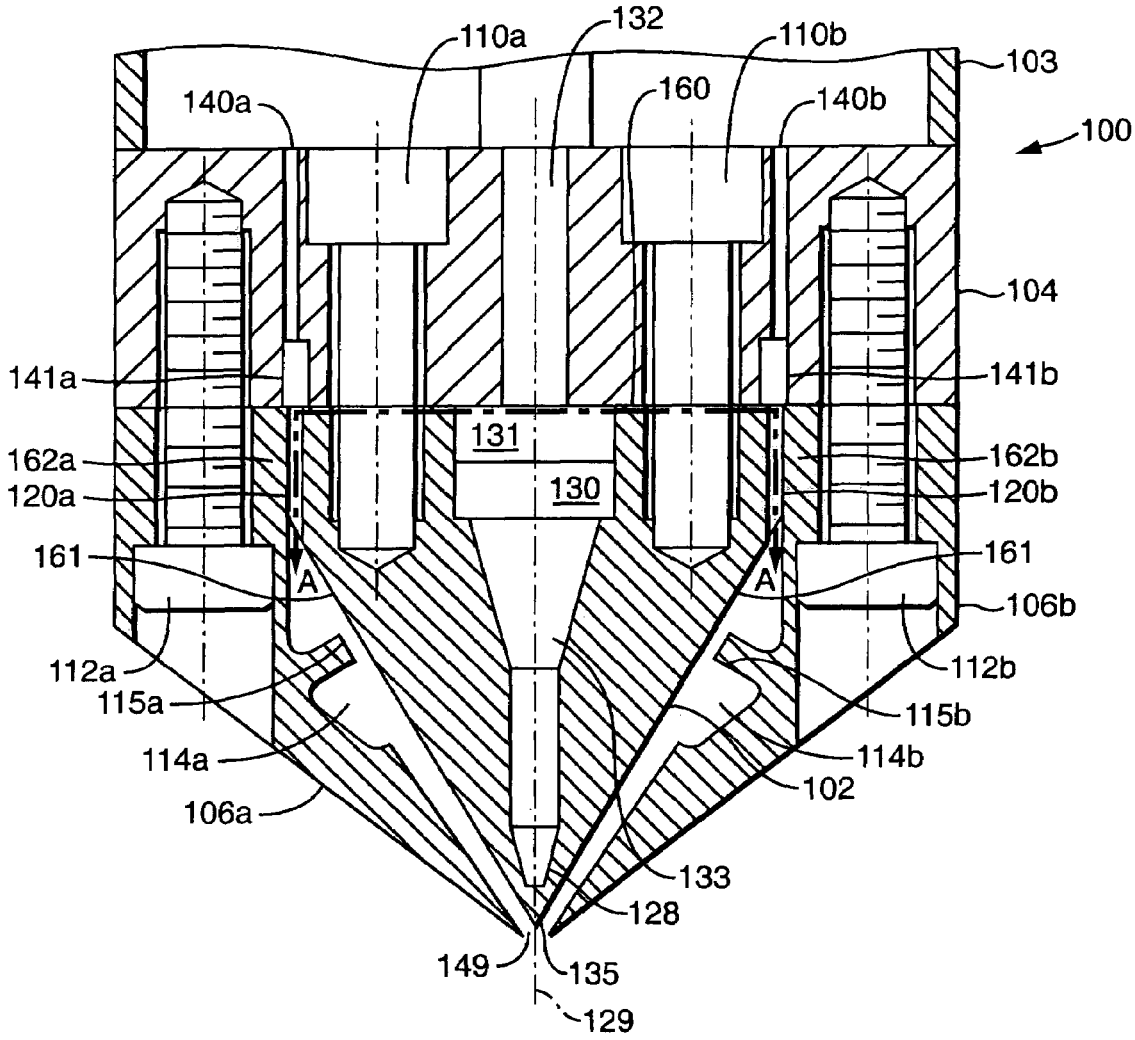
FIG. 2 shows a cross-section view of a meltblowing die of the present invention.

Turning to FIG. 2, this figure shows one embodiment of a meltblowing die 100 of the present invention in a partial cross-sectional view. In FIG. 2 a die tip 102 is mounted indirectly to a die body 103 (partially shown) through a mounting plate 104. Also mounted indirectly to a die body mounting plate 104 or are a first air plate 106*a* and second air plate 106*b*. The die tip 102 in mounted to the mounting plate 104 using any suitable means, such as bolts. Bolts 110*a* and 110*b* are shown as the mounting means in FIG. 2. In a similar manner, the air plates 106*a* and 106*b* are also mounted to the mounting plate 104 using a suitable mounting means, such as bolts. Bolts 112*a* and 112*b* are shown as the mounting means for the air plates in FIG. 2. It is noted that a mounting plate 104 is not necessary and the die tip 102 and air plates 106*a* and 106*b* may be mounted directly to the die 103. It is desirable to mount the die tip 102 and air plates 106*a* and 106*b* to the mounting plate 104, since it is easier to attach the die tip to the mounting plate 104 than the die body 103 using a mounting means (not shown).

The die tip 102 has a top side 160, and two sides 162*a* and 162*b*, which extend from the top side towards the bottom side 161 of the die tip. In addition, the die tip may have a die tip apex 128 and a breaker plate/screen assembly 130. The material which will be formed into fibers is provided from the die body 103 to the die tip 102 via a passageway 132. The material passes through distribution plate 131 from the passageway 132 to the breaker plate/screen assembly 130.

Once through the breaker plate/filter assembly 130, which serves to filter the material to prevent any impurities which may clog the die tip from passing any further through the die tip 102, the material passes through a narrowing passage 133 to narrow cylindrical or otherwise shaped outlet 129, which ejects the material, thereby forming fibers. Typically, the outlet 129 will generally have a diameter in range of about 0.1 to about 0.6 mm. The outlet 129 is connected to the narrowing passage 133 via capillaries 135, which have the diameter about the same as the outlet and the capillaries will have a length which is generally about 3 to 15 times the diameter of the die tip capilliaries. The actual diameter and length of the outlet and capillaries may vary without departing from the scope of the present invention.

A high velocity fluid, generally air, must be provided to die tip outlet 129 in order to attenuate the fibers. In the meltblown die of the present invention, the attenuating fluid is supplied through an inlet (not shown in FIG. 2 but is discussed in more detail in FIG. 8 below) in the die body 103, thereby saving space in the machine direction. In many conventional and commercially used meltblowing dies, the attenuating fluid is supplied external to the die body, thereby requiring large amounts of space in the machine direction The attenuating fluid passes through from the die body 103 through passages 140*a* and 140*b* in the mounting plate 104 into distribution chambers 141*a* and 141*b*, respectively. The distribution chambers allow mixing of the attenuating fluid. From the distribution chambers 141*a* and 141*b*, the attenuating fluid is then passed between the air plates 106*a* and 106*b* and die tip 102 via passages 120*a* and 120*b*. The air plates 106*a* and 106*b* are secured to the mounting plate 104 (alternately the die body 103) in such a way that the air plates 106*a* and 106*b* and the die tip 102 form passages 120*a* and 120*b*, which allow the attenuating fluid to pass from the distribution chambers 141*a* and 141*b* in mounting plate 104 towards the outlet opening 129 in the die tip. In addition, air plates 106*a* and 106*b* are proximate to the bottom of the die tip 161 such that channels 114*a* and 114*b* which allow the attenuating fluid to pass from the passages 120*a* and 120*b* to the outlet opening 149 of the meltblowing die 100. Baffles 115*a* and 115*b* aid in the mixing of the attenuating fluid in the channels 114*a* and 114*b* so that streaking of the attenuating fluid does not occur.

The meltblown dies of the present invention have a reduced width in the machine direction. Typically, the meltblown dies of the present invention have a machine direction width of less than about 16 cm (6.25 in). Most of the meltblown dies of the present invention have a machine direction width in the range of about 2.5 cm (1 inch) to about 15 cm (5.9 inches) and desirably about 5 cm (2 inches) to about 12 cm (4.7 inches). This reduced size is a direct result of any one of the unique features of the meltblown dies which are described below in greater detail.

A first feature of the meltblown dies of the present invention is that the attenuating fluid is introduced to the meltblown die assembly in the die body 103. In order to get the attenuating air from the die body 103 to the outlet 149 of the meltblowing 100, the present invention provides passages or channels 120*a* and 120*b* created by the die tip 102 and the air plates 106*a* and 106*b*, respectively. Any means can be used to form the passage ways 120*a* and 120*b*. One method of providing these channels is to form the die tip such that the sides of the die tip 162*a* and 162*b* have grooves or channels (shown in FIG. 3) extending form the top side 160 to the bottom side 161 of the die tip. The grooves are formed by forming a series of raised portions on the sides 162*a* and 162*b* which are separated by a series of depressed areas or channels. Stated another way, the raised portions on the sides 162*a* and 162*b* of the die tip define the channels and these channels extend from the top side 161 of the die tip to the bottom side 161 of the die tip.

Figure 3:
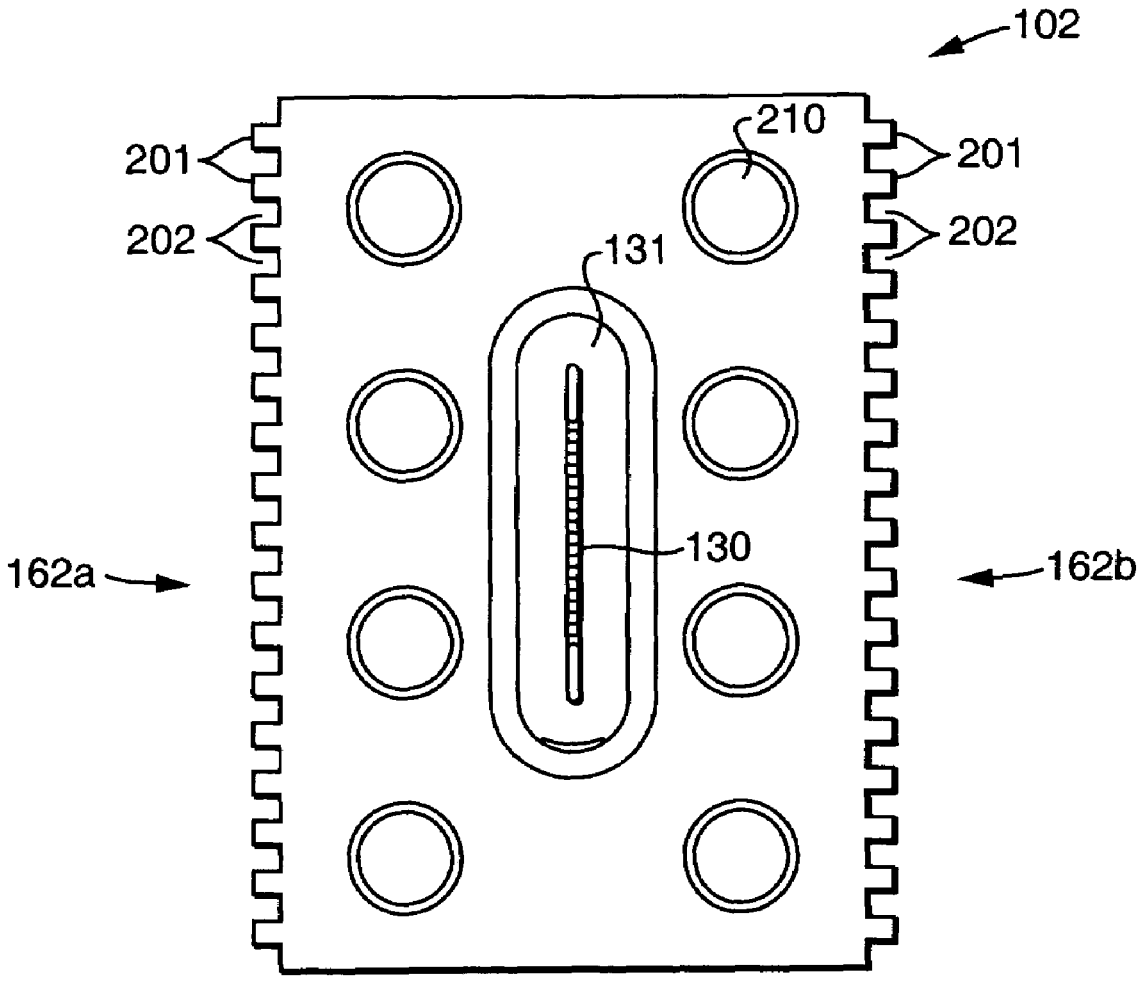
FIG. 3 shows a partial top view of a meltblowing die tip portion of FIG. 2.

To obtain a better understanding of the structure and the channels formed on the sides of the die tip, attention is directly to FIG. 3, which shows a top view of the die tip 102, looking down onto surface 160 along section line A—A in FIG. 2. A series of raised portions 201 on the sides 162*a* and 162*b* of the tip 102 define a series of channels 202 in each side (162*a*, 162*b*) of the die tip. The air plates 106*a* and 106*b* (FIG. 2) are fitted against the raised portions 201, such that passage ways 120*a* and 120*b* (FIG. 2) are formed by the channels 202 and the air plates. This allows for the attenuating fluid to pass from the die body 103 or mounting plate to the outlet 149 of the meltblowing die 100. The channels created on the sides of the die tip will have a width, or the distance between the raised portions (w) and a depth, or the distance the raised portions extend away from the recessed portion of the channel (d). Depending on the overall size of the meltblown die, the channels 202 formed can be from about 0.25 mm to about 4.0 mm in width(w) and from about 0.25 mm to about 4.0 mm deep (d). Generally, it is desired the channels are from about 0.4 mm to about 3.0 mm wide (w) and from about 1.5 mm to about 3.0 mm deep (d). As an alternative, other methods of providing passage ways 120*a* and 120*b* between the air plates and the die tip can be used, such as, for example providing air plates with a series of raised portions defining a series of channels in much of the same way the channels are provided on the side of the diet tip. However, from a cost standpoint, it is preferred that the die tip, which is already produced by machining, is provided with the series of raised portions.

In addition, the raised portions 201 on the sides of the die tip also provided a way to align the air plates 106*a* and 106*b* in the die assembly. The air plates can rest directly on the sides of the die tip 102 and are held in place by any suitable mean, generally bolts. This can avoid the need for spacers or aligning plates which are generally used on conventional meltblowing dies.

The passage ways 120*a* and 120*b* formed from the series of raised portions 201 on the sides of the die tip 102 and the air plates 106*a* and 106*b*, allow for attenuating fluid distribution prior to the entrance of the converging air nozzles at the outlet 149 of the meltblowing die. The structure formed by the raised portions 201 and the air plates 106*a* and 106(*b*) is very similar to that a perforated plate. Perforated plates tend to yield better or nearly ideal air distribution than other structures used in air distribution Another feature of the present invention is that the die tip 102 is mounted to the mounting 104 using a mounting mechanism which extends from the mounting plate 104 (or die body 103) into the top surface 160 of die tip 102. As shown in FIG. 2, the die tip 102 is mounted to the mounting plate 104 with a mounting means extending from the mounting plate 104, through the top surface 160 of the die tip and into the die tip 102. FIG. 3 shows that the mounting holes 210 for mounting the die tip 102 to the mounting plate 104 are located on the top surface 160 of the die tip 102.

Conventionally, die tips are mounted with a mounting mechanism on the bottom side of the die tip, which exposes the mounting mechanism to the attenuating air. The attenuating fluid which passes through the meltblowing die is sometimes referred to as "primary fluid", in the case of air as the attenuating fluid, "primary air". It has been discovered that when the mounting mechanism, usually bolts, is exposed to the attenuating fluid stream, this tends to cause streaks in the attenuating fluid, thereby adversely affecting the formation of the fibers. By mounting the die tip 102 to the mounting plate 104 using a mounting mechanism from the top surface 160 of the die tip 102 rather than the bottom surface 161 of the tip, improve fiber formation can be realize due to the lack of streaks cause by the mounting mean for the die tip 102 in the primary fluid flow. It has been discovered that the reduced size of the meltblowing die improves the fluid entrainment of the primary attenuating fluid.

Also shown in FIG. 3 are the polymer distribution plate 131 and the breaker plate/screen 130, as viewed from the top of the die tip 102.

Figure 4:
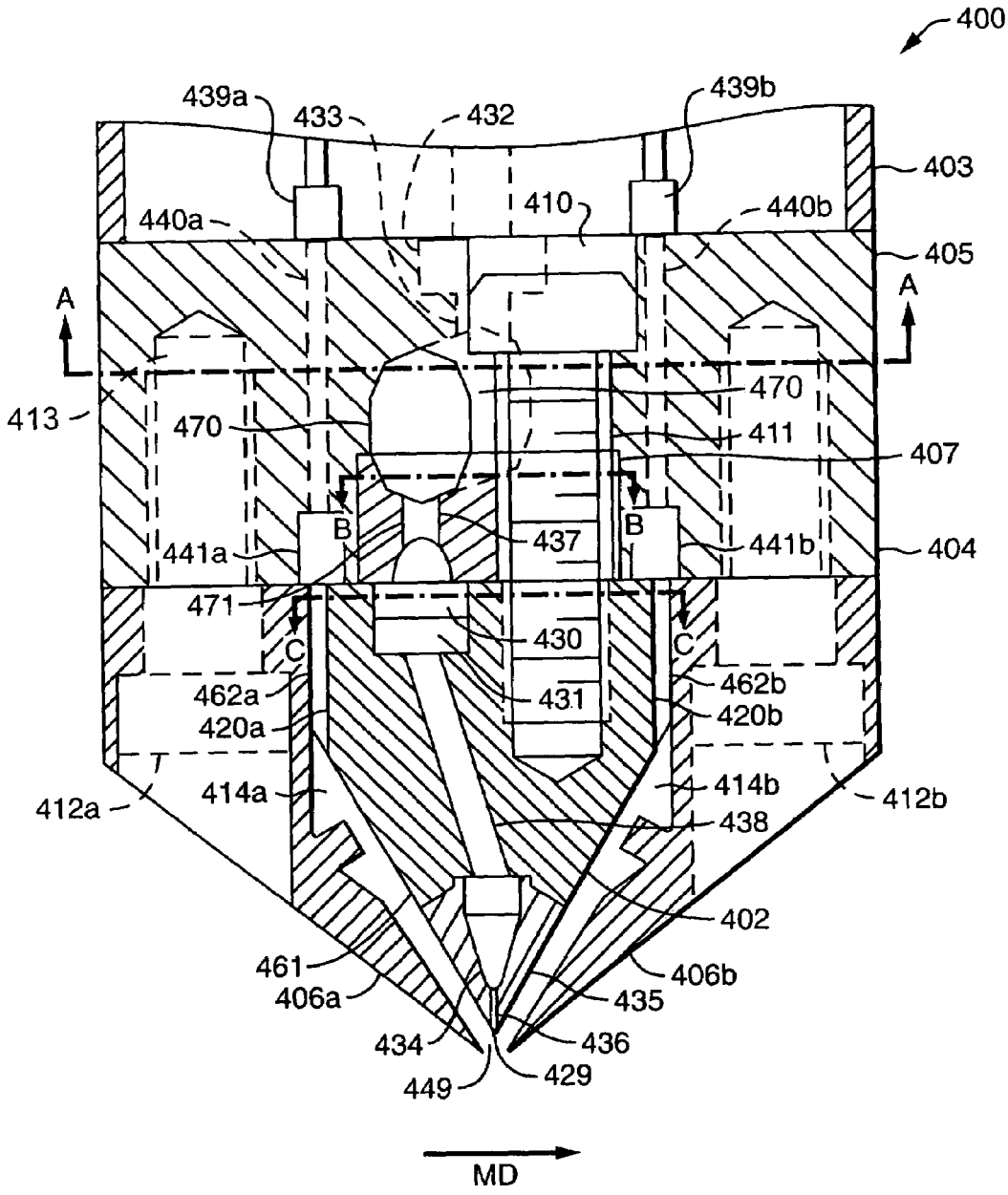
FIG. 4 shows a cross-section view a meltblowing die of the present invention.

An alternative meltblowing die within the present invention is shown in FIG. 4 in an enlarged view. In FIG. 4, this figure shows an alternative embodiment of a meltblown die 400 of the present invention in a partial cross-sectional view. In FIG. 4 a die tip 402 is mounted to a mounting plate 404. Also mounted to the mounting plate 104 are a first air plate 406*a* and a second air plate 406*b*. The die tip 402 is mounted to the mounting plate 404 using any suitable mount means discussed above. As shown in FIG. 4 bolts 410 are used as a suitable mounting means. In a similar manner, the air plates 406*a* and 406*b* are also mounted to the mounting plate 404 using a suitable means, such as bolts 412*a* and 412*b*. It is pointed out that the mounting plate is optional, but desirable as stated above.

The die tip 402 has a top side 460, and two sides 462*a* and 462*b*, which extend from the top side towards the bottom side 461 of the die tip 402. As with the meltblown die shown in FIG. 2, the air plates 406*a* and 406*b* of the meltblown die of FIG. 4 are secured to the mounting plate 404 in such a way that the air plates 406*a* and 406*b* and the die tip 402 form passages 420*a* and 420*b*, which allow the attenuating fluid to pass from the distribution chambers 441*a* and 441*b* present in mounting plate 404 towards the outlet opening of the meltblown die 449. The attenuating fluid system operates in the same manner as describe above for FIG. 2. The attenuating fluid passes from chambers 439*a* and 439*b* in the die body 403 into passages 440*a* and 440*b* and into distribution chambers 441*a* and 441*b*, respectively. From the distribution chambers 441*a* and 441*b*, the attenuating fluid is then passed between the air plates 406*a* and 406*b* and die tip 402 via passages 420*a* and 420*b*. In addition, air plates 406*a* and 406*b* are proximate to the bottom of the die tip 461 such that channels 414*a* and 414*b* which allow the attenuating fluid to pass from the passages 420*a* and 420*b* to the outlet 449.

In the die configuration shown in FIG. 4, a unique die tip mounting and polymer distribution system (also called a polymer distribution chamber) is used. The polymer distribution system used has a non-linear course in the cross-machine direction. In addition, the mounting means 410 is alternated from side to side or staggered to allow for the non-linear course of the polymer distribution system. To gain a better understanding of the non-linear polymer distribution system and the alternating mounting means, attention is directed to FIG. 5, which shows a partial bottom view, in the cross machine direction, of the mounting along cut section line A—A in FIG. 4.

Figure 5:
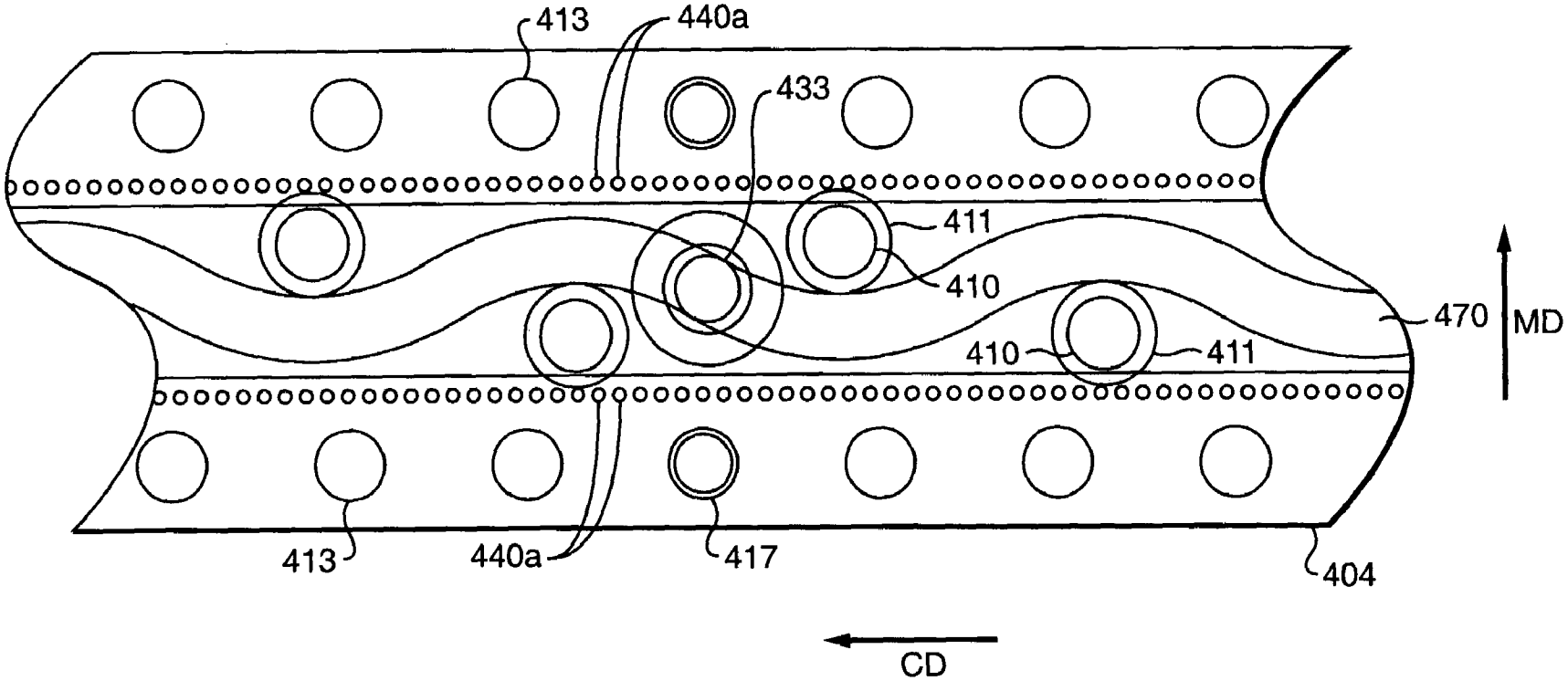
FIG. 5 shows a partial bottom view of the mounting plate of the meltblown die of FIG. 4.

In the operation of the meltblown die 400, the material which will be formed into fibers is provided to and from the die body 403 to the die tip 402 via a passageway 432. The passage 432 may narrow to a smaller passage 433 which is directly connected to a polymer distribution chamber 470. The polymer distribution chamber 470 has a non-linear course in the cross-machine direction, as is shown in FIG. 5. In FIG. 5, the top of the polymer distribution chamber 470 meets the passage 433 near the center of the mounting plate 404. The material to be formed into the fibers enters and flows through the polymer distribution chamber 470. As is seen, the polymer distribution chamber 470 has a non-linear course in the cross-machine direction. The polymer distribution chamber 470 weaves a path around the die tip mounting means 410 and the tap holes 411. Although shown as a serpentine shape, other non-linear courses can be used for the polymer distribution chamber 470, for example a zigzag pattern. Also shown in FIG. 5 are the fluid passages 440*a* and 440*b* and the tap holes 413 for the air plate mounting means 412*a* and 412*b*. The mounting plate 404 is mounted to the die body via a suitable attachment mean via tap holes 417 shown in FIG. 5.

Figure 6:
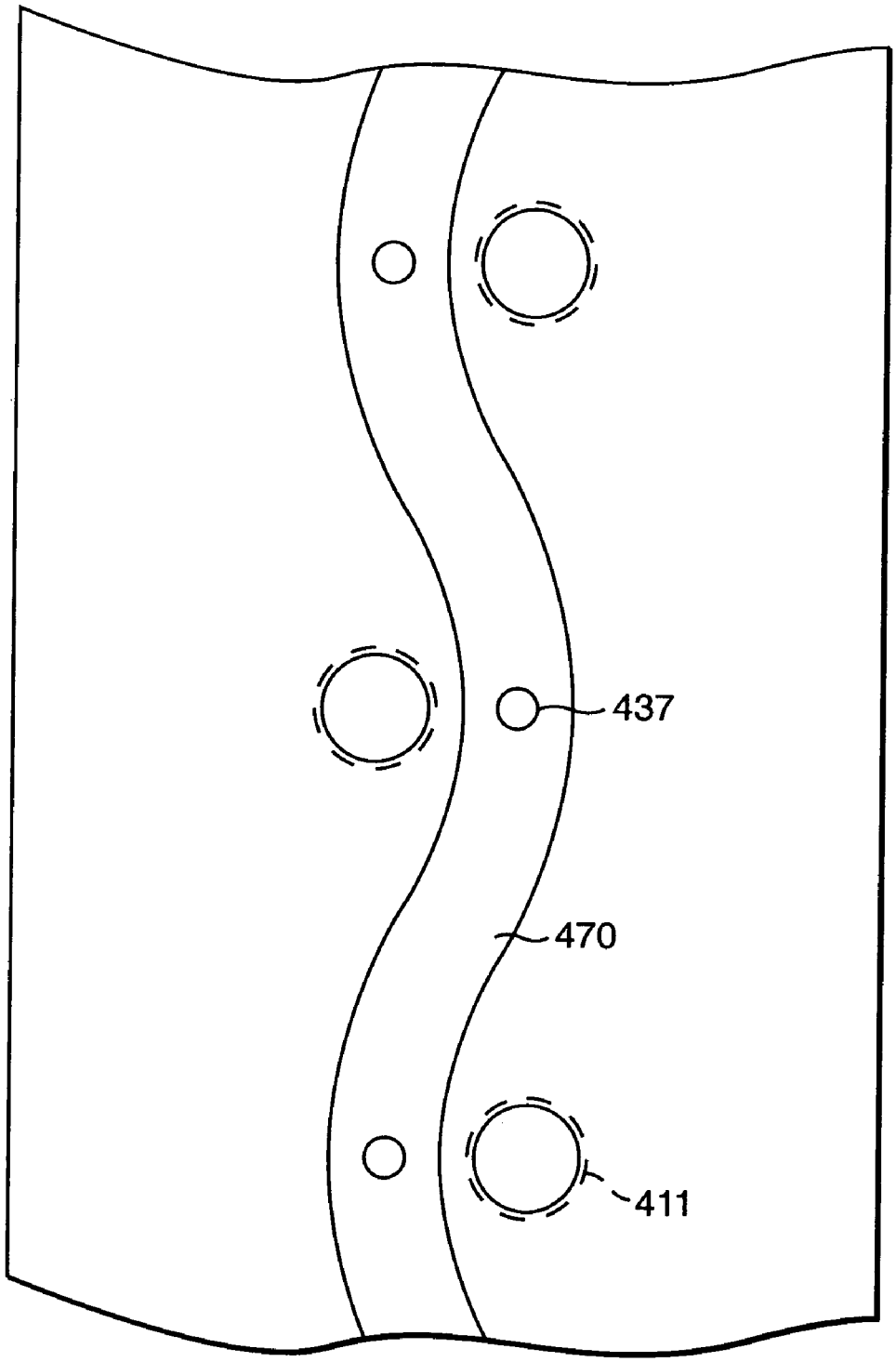
FIG. 6 show a partial top view of the mounting plate with a non-linear polymer distribution chamber.

Once in the polymer distribution chamber 470, the material to be formed into the fibers is then passed into a passage 471 towards polymer distribution plate 430 and the breaker plate/filter assembly 431. As with the top of the polymer distribution chamber 470, the bottom of the polymer distribution chamber 470 also has a non-linear course in the cross-machine direction. The top of the chamber and the bottom of the chamber will generally have the same shape. Therefore, the distribution of the material to be formed into fibers from the chamber 470 to the die-tip 402 will also have a unique configuration. This configuration is shown in FIG. 6, which is a partial sectional view of the die assembly looking down from sectional line B—B. As is seen in FIG. 6, the bottom of the polymer distribution chamber 470 has a shape similar to that as the top of the chamber. The outlet 437 from polymer distribution chamber 470 is positioned around the die tip mounting means 410 and the die tip mounting means tap hole. This allows for the material to pass into the die tip 402.

Figure 7:
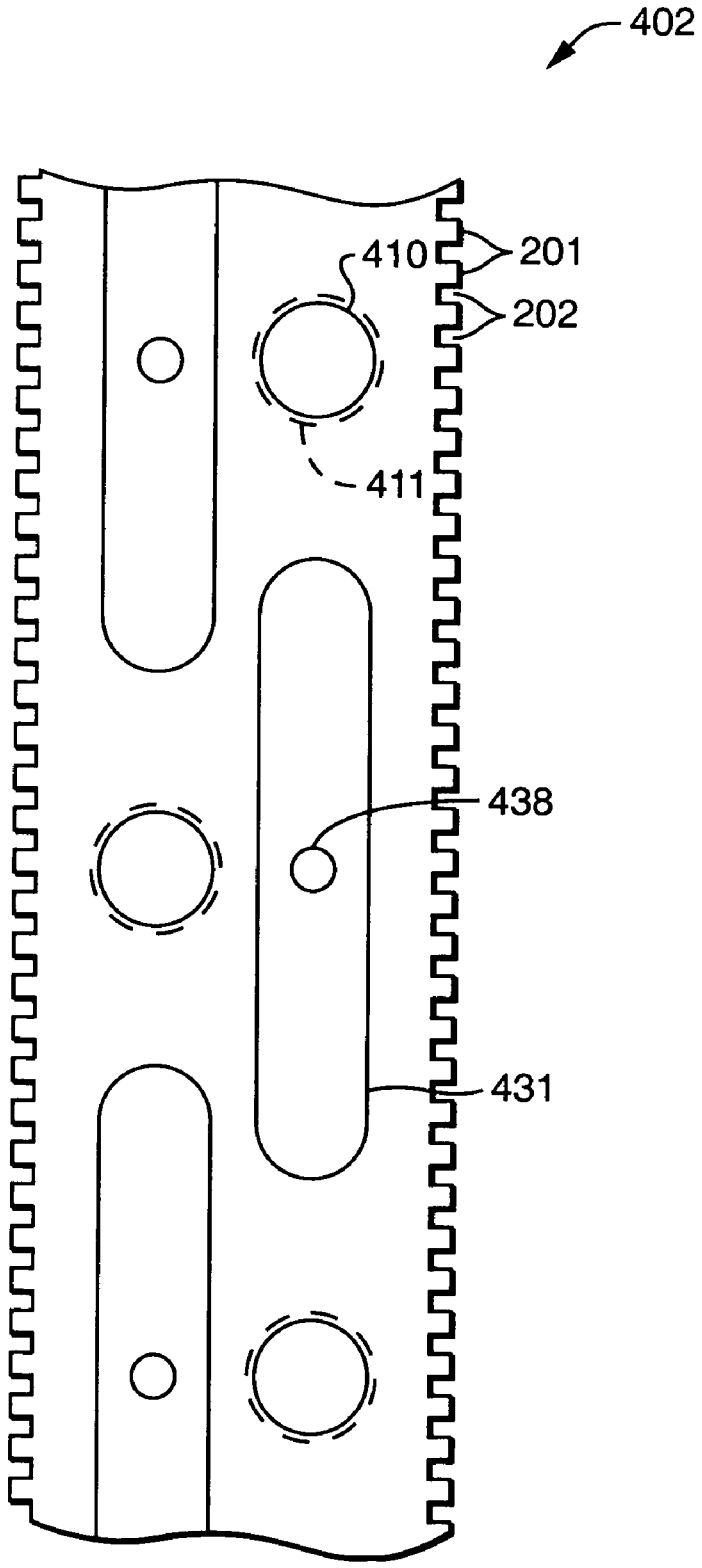
FIG. 7 shows a partial top view of the meltblowing die tip of FIG. 4.

In addition, the top of the die tip 402 will have a unique structure. Shown in FIG. 7 is a partial view of the die tip 402 looking down from sectional line C—C, with the breaker plate/filter assembly removed. Once through passage 438, called the polymer port, the material enters the die tip 402 and into the polymer distribution plate area. Once at the polymer distribution plate, the polymer preferably passes through a breaker plate/screen (not shown) to filter the material so the impurities will not clog the outlet 429 form the die tip 402. The material exits the breaker plate, the material will enter into a passage to take the material to the final capillaries to form the fibers. As is shown in FIG. 7, the die tip 402 may further have a series of raised portions 201 defining a series of channels 202 which are described above in greater detail. Also shown in FIG. 7 are the tap holes 411 for the die tip mounting means 410.

Returning to FIG. 4, from the polymer port 438, the material may optionally enter an optional polymer pooling chamber 434. The polymer pooling chamber 434 may be the length of the meltblown die in the cross-machine direction or the polymer pooling chamber may be a series of chambers. Ideally, the polymer pooling chamber is a series of chambers. The polymer pooling chamber is not required, but allows the polymer passing through the polymer ports to be supplied to a common channel before being fed to the final capillaries 436. The final capillaries may be cylindrical or otherwise shaped outlets and allow the polymer to be ejected the material into the die tip outlet openings 429, thereby forming fibers.

By using a non-linear polymer distribution chamber 470, the overall width of the meltblowing die can be reduce in the machine direction. Meltblowing dies having this configuration can be made to have machine direction widths of about 5 cm (2 inches or more, generally up to about 14 cm (6 inches). Larger meltblown dies may also use this configuration as a space saving measure.

As can be seen in FIG. 4, the die tip 402 may be formed from two pieces, the upper portion 437 and a lower portion 435. The upper portion 437 houses the polymer ports the breaker plate assembly 431 and is in contact with the mounting plate 404. The lower portion 435 of the die tip houses the polymer pooling chamber 434 and the final capillaries 436 is shown as a separate section 435 of the die-tip 402. The die tip is advantageously produced in two parts so that the polymer ports 438 can be easily machined into the die tip. This is especially true since the polymer ports in FIG. 4 are machined into the die tip 402 at an angle to get the polymer from the breaker plate/filter assembly 431 to the outlet of the die tip 429. When the two piece die tip 402 is used, the lower section 435 with polymer pooling chamber and the upper section 437 may be joined together using known techniques, such as electron beam welding. It is further noted that a two piece die tip maybe prepared in the embodiment of FIG. 2; however, it is not necessary since the polymer ports and final capillaries are perpendicular to the top of the die tip 102.

As can also be seen in FIG. 4, the mounting plate 404 can be prepared in two or more pieces, for example the mounting plate can have an upper portion 405 and a lower portion 407. As with the die tip, the non-linear polymer distribution chamber 470 needs to be machined into the mounting plate 402. One way to accomplish this task is to form a two piece mounting plate as shown in FIG. 4. The two pieces of the mounting plate may be joined together by any known technique, provided the joining method will withstand the processing conditions applied to the meltblown die.

Figure 8:
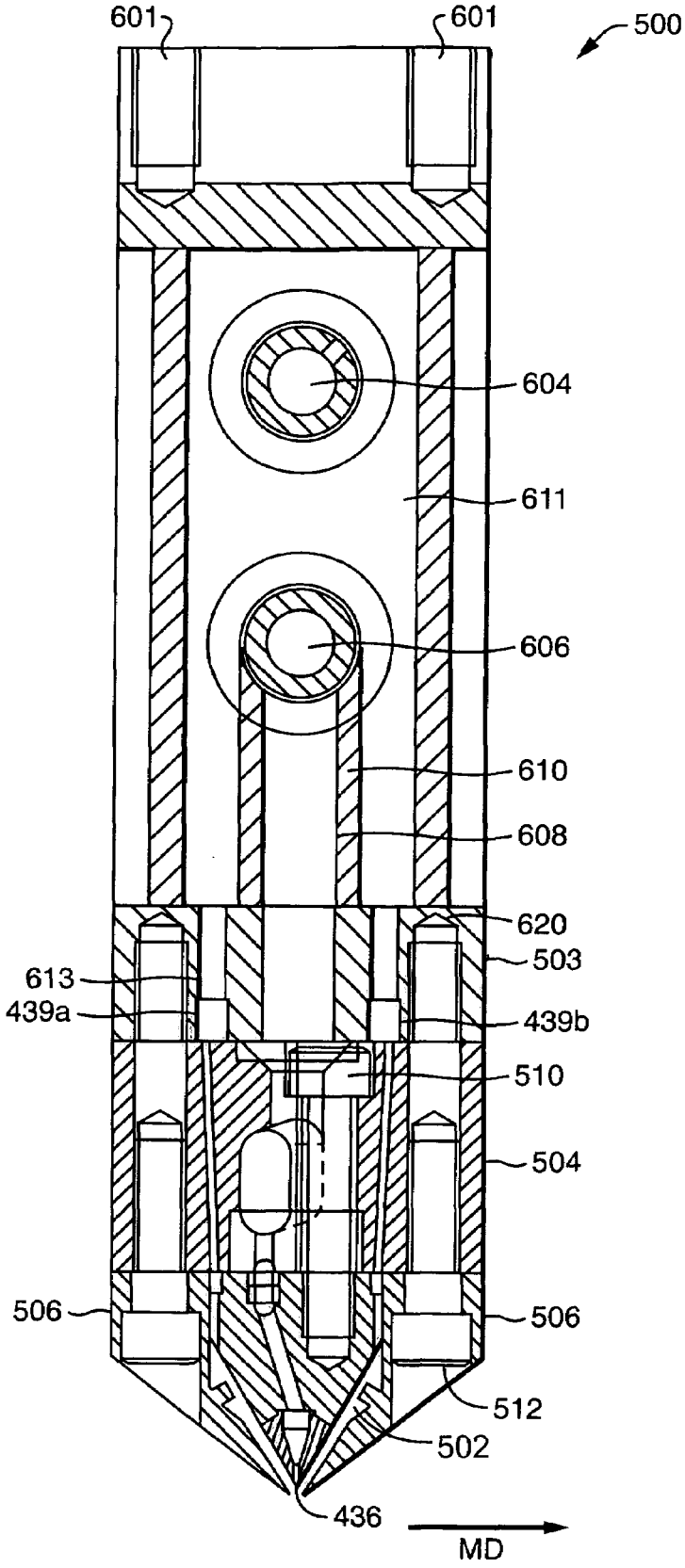
FIG. 8 shows a cross-section view of a meltblowing die of the present invention with a mounting plate used to hold the die tip of FIG. 4 to the die body.

In order to obtain a full and overall understanding of the many features of the meltblowing dies of the present invention, certain features die body have not been discussed in detail above. Attention is now directed to FIG. 8, which shows cross section of an overall meltblowing die of the present invention.

In FIG. 8, a melt blowing die 500 is shown in a cross-sectional view. The meltblowing die 500, has die body 503, an optional mounting plate 504, a die tip 502 and air plates 506. The die body 503 is mounted to a support not shown, by a suitable mounting mean via tap holes 601. In the die body 503, there is an attenuating fluid inlet 604 and a material inlet 606. The material which is to be formed into the meltblown fibers, typically a polymeric material.

The material is typically provided from a hopper (not shown) to an extruder (not shown) and is typically heated to bring the material to the desired temperature and viscosity. The molten material is provided to the meltblowing die via the material inlet 606. The material may also be heated in the meltblowing die by means heater (not shown). Once in the die body, the material passes through a 610 to a the mounting plate 504. From there the polymer passes through the mounting plate 504 to the die tip 502 and through final capillaries and forms fibers as it exits the capillaries. As shown in FIG. 8, the mounting plate 504 and die tip 502 are identical to the mounting plate and die tip shown in FIG. 4. Therefore, the flow of the material through the mounting plate will not be repeated. For a full discussion please refer to the discussion of FIG. 4.

The attenuating fluid enters into the meltblowing die through the opening in the die body 604. The attenuating fluid may or may not be heated prior to entering the die body 503. As the attenuating fluid enters into the die body, the fluid enter a chamber 611. From this chamber, the attenuating fluid is sent through passages 613 on its way to chambers 439*a* and 439*b*. From this point the attenuating fluid passes through the mounting plate 504 and between the die tip 502 and the air plates 506 in a manner describe above. Attention is again directed to the discussion of the attenuating fluid associated with FIG. 4.

The mounting plate 504 is mounted to the die body 503 via a suitable mounting means 620. Any suitable means may be used, but it is generally preferred that bolts are used to mount the mounting plate to the die body. As is stated above, the mounting plate 504 is optional. The die tip is mounted to the mounting plate 504 via a mounting means 510 which mounts the die tip to the mounting plate through the top of the die tip 502. Again, it is desirable that a bolt is used to mount the die tip to the mounting plate since bolts are easily removed is disassembly of the meltblowing die is necessary. Finally, the air plates 506 are also mounted to the mounting plate using a mounting means, preferably a bolt.

As describe above, the presenting invention is described in term of having mounting plate between the die tip and the die body. As is stated above, the mounting plate is optional, but desired since it is easier to mount the die tip and air plated to the overall assembly and it is often easier to form the necessary passages and channels in a mounting plate verses the die body per se.

As is set forth above, the present invention is directed to reducing the machine direction width of the meltblowing die. Other ways of making the meltblowing die smaller include, for example, reducing the size of the mounting hardware, using mounting hardware with a small width in the machine direction, such as T-bolts and reducing the filter size in the breaker plate.

An additional feature which can be incorporated is a means to turn the polymer supply off and on in the die tip. The reduced size means that less polymer is present in the meltblowing die at a given time. In conventional meltblowing dies, it is difficult to turn the polymer supply off and on in a designed fashion due to the high polymer content at a given time. However, with the reduce polymer content in the meltblowing die of the present invention at a given time, the polymer supply can more readily be stopped and started without the problems found in conventional meltblowing dies, due to the reduced volume of polymer in the die tip.

The die tip, itself, may be manufactured from materials conventionally used for manufacturing die tips such as stainless steel, aluminum, carbon steel or brass. In alternative embodiments, the die is manufactured from insulating materials. The die tip may be constructed of one piece or may be of multi-piece construction, and the die openings may be drilled or otherwise formed. Given the size of the die tips of the present invention and the angles of some of the polymer ports, it is generally preferred, but not required that die-tip is prepared in two pieces and the two pieces are welded together. When a two part die tip is produced, the parts are electron beam welded together. Similarly, the mounting plate may also be prepared from more than one piece The fibers produced using the meltblowing die of the present invention can be prepared from any polymer, in particular, any thermoplastic polymer. Polymers suitable for the present invention include the known polymers suitable for production of nonwoven webs and materials such as for example polyolefins, polyesters, polyamides, polycarbonates and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene; polybutylene, e.g., poly(1-butene) and poly(2-butene); polypentene, e.g., poly(1-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include polylactide and polylactic acid polymers as well as polyethylene terephthalate, poly-butylene terephthalate, polytetramethylene terephthalate, polycyclohexylene-1,4-dimethylene terephthalate, and isophthalate copolymers thereof, as well as blends thereof. The particular polymer selected will depend on the intended use of the resulting nonwoven web. In addition to the polymer, other additives, such as colorants, fillers and process aids may be present in the material which is to be formed into fibers.

The selection of a particular attenuating fluid will depend on the polymer being extruded and other factors such as cost. In most cases, the attenuating fluid will be air. It is contemplated that available air from a compressor may be used as the attenuating fluid. In some cases it may be necessary to cool the air in order to maintain a desired temperature differential between the heated polymer and the attenuating fluid. In all cases, however, it is essential that the desired minimum temperature differential be maintained in order to permit the reduced forming distances and obtain the above described advantages. In addition to air, other available inert gases may be used for attenuating in exceptional cases.

An insulating material may be used to protect the molten polymer from the attenuating fluid. Any material used may be applied or attached to the die tip in a desired manner and yet withstand the conditions of extrusion. For example, materials such as porous silica borosilicate may be used. The thickness of the insulating layer will depend upon the properties of the insulating material as well as the space available but generally will be at least about 0.5 millimeter and preferably at least 1 millimeter. When such insulating materials are used, lower polymer temperatures may be employed without increasing the danger of polymer solidification within the die. Conversely, when insulating material is not used, increasing the temperature of the polymer or otherwise lowering the polymer viscosity will reduce the incidence of polymer solidification within the die.

The small size of the meltblowing die of the present invention also provides other advantages over conventional meltblowing dies. The small machine direction width allows for the meltblowing dies to be placed in other nonwoven web formation lines, such that new and different materials can be formed. Conventional meltblowing dies have a large machine direction width, hence lines already having a nonwoven production machine in place cannot usually be modified to add a meltblowing process to the line. The reduced size improves the secondary air entrainment. Secondary air is the air which is not processed through the meltblowing die. As a result, the meltblown nonwoven web produced from the fibers has improved qualities, such as, improved barrier properties and improved filtration properties. In addition, the small machine direction width allows for several banks of the meltblown dies to be placed in series a long the machine direction. It can be beneficial to have several banks of meltblowing in the machine direction to produce high basis weight material or to create a gradient fiber size structure, which is particularly useful in producing filter materials.

While the embodiments of the invention described herein are presently preferred, various modifications and improvements can be made without departing from the spirit and scope of the invention. The scope of the invention is indicated in the appended claims, and all changes that fall within the meaning and range of equivalents are intended to be embraced therein.

We claim:

1. A meltblowing die comprising a. a die body;

b. a die tip comprising a top side, a bottom side, a first side and a second side, wherein the top side is mounted to the die body, the bottom side is opposite the topside, the first side and the second side each extend from the topside towards the bottom side, the first side and the second side are opposite each other, c. a first air plate, wherein a portion of the first air plate is in contact with the first side of the die tip and a series of passages are formed by the first side of the die tip and the first air plate; and d. a second air plate, wherein a portion of the second air plate is in contact with the second side of the die tip and a series of passages are formed by the second side of the die tip and the second air plate.

2. The meltblowing die of claim 1, wherein the die body further comprises a mounting plate, wherein the die tip and the first and second air plates are mounted to the mounting plate.

3. The meltblowing die of claim 1, where the first side of the die tip and the second side of the die tip each have a surface comprising a series of raised portions extending from the top side the die tip towards the bottom side of the die tip defining a series of channels in each side of the die tip extending from the top side of the die tip towards the bottom side of the die tip and the first air plate contacts at least a portion of the raised portions of the first side of the die tip and the second air plate is in contact with at least a portion of the raised portions of the second side of the die tip.

4. The meltblowing die of claim 2, wherein the first side of the die tip and the second side of the die tip each have a surface comprising a series of raised portions extending from the top side the die tip towards the bottom side of the die tip defining a series of channels in each side of the die tip extending from the top side of the die tip towards the bottom side of the die tip and the first air plate contacts at least a portion of the raised portions of the first side of the die tip and the second air plate is in contact with at least a portion of the raised portions of the second side of the die tip.

5. The meltblowing die of claim 2, wherein the die tip is mounted to the mounting plate with a mounting means which extends from the mounting plate into the die tip.

6. The meltblowing die of claim 4, wherein the die tip is mounted to the mounting plate with a mounting means which extends from the mounting plate into the die tip.

7. The meltblowing die of claim 2, wherein the first air plate and the second air plate are mounted with a mounting means to the mounting plate.

8. The meltblowing die of claim 4, wherein the die body comprises an inlet for a material to be formed into fibers and an inlet for a attenuation fluid which attenuates the fibers.

9. The meltblowing die of claim 2, wherein the mounting plate has a series of passages which allow an attenuation fluid to flow from the die body to the series of passages formed by the first and second air plates and the first and second sides of the die tip.

10. The meltblowing die of claim 4, wherein the mounting plate has a series of passages which allow an attenuation fluid to flow from the die body to the series of passages formed by the first and second air plates and the first and second sides of the die tip.

11. The meltblowing die of claim 2, wherein the mounting plate comprises a distribution chamber which provides a pathway for a material to be formed into fibers from the die body to the die tip wherein the distribution chamber has a non-linear course in the cross-machine direction.

12. The meltblowing die of claims 11, wherein the non-linear course of the distribution chamber comprises a serpentine shape.

13. The meltblowing die of claim 10, wherein the mounting plate comprises a distribution chamber which provides a pathway for a material to be formed into fibers from the die body to the die tip wherein the distribution chamber has a non-linear course in the cross-machine direction.

14. The meltblowing die of claim 11, wherein the die tip further comprises a breaker plate/filter assembly, a series of polymer ports, and a pooling chamber, wherein the polymer ports provide pathways for a material to be formed into fibers from the breaker plate and filtering assembly to the pooling chamber.

15. The meltblowing die of claim 14, further comprises a series of capillaries which connect the pooling chamber to an outlet of the die tip.

16. The meltblowing die of claim 15, wherein the die tip comprises two pieces, an upper piece and a lower piece, wherein the upper piece comprises the breaker plate/filter assembly, and the series of polymer ports, and the lower piece comprises the polymer pooling chamber, the series of capillaries and the outlet of the die tip.

17. The meltblowing die of claim 1, wherein the meltblowing die has an overall width in the machine direction of between 5 and 12 cm.

18. A process of producing a nonwoven web comprising generating fibers with the meltblowing die of claim 1.

* * * * *